US007785051B2

(12) United States Patent
Kanczuzewski et al.

(10) Patent No.: US 7,785,051 B2
(45) Date of Patent: Aug. 31, 2010

(54) DEVICE AND METHOD FOR SUPPORTING CARGO

(75) Inventors: Thomas E. Kanczuzewski, South Bend, IN (US); John Townsend, Paw Paw, IN (US); John W. Doster, Granger, IN (US); Dean Catanzarite, South Bend, IN (US)

(73) Assignee: Logistick, Inc., South Bend, IN (US)

( * ) Notice: Subject to any disclaimer, the term of this patent is extended or adjusted under 35 U.S.C. 154(b) by 575 days.

(21) Appl. No.: 11/866,783

(22) Filed: Oct. 3, 2007

(65) Prior Publication Data

US 2009/0090827 A1 Apr. 9, 2009

(51) Int. Cl.
*B60P 7/08* (2006.01)

(52) U.S. Cl. ..... 410/89; 410/143; 410/144; 410/152

(58) Field of Classification Search ..... 410/46, 410/89, 90, 91, 129, 143, 144, 152; 105/370; 211/191, 192, 105.1, 206; 248/357, 205.3
See application file for complete search history.

(56) References Cited

U.S. PATENT DOCUMENTS

| | | | |
|---|---|---|---|
| 969,002 | A | 8/1910 | Teachout |
| 1,401,419 | A | 12/1921 | McNally |
| 1,951,660 | A | 3/1934 | Klaudt |
| 2,124,082 | A | 7/1938 | Reifer |
| 2,414,160 | A | 1/1947 | Moon |
| 2,464,080 | A | 3/1949 | Hankins |
| 2,467,681 | A | 4/1949 | McKinney |
| 2,468,101 | A | 4/1949 | Nampa |
| 2,697,631 | A | 12/1954 | Miller |
| 2,752,864 | A | 7/1956 | McDougal, Sr. et al. |
| 2,766,704 | A | 10/1956 | McMahon |
| 2,845,245 | A | 5/1958 | Gray et al. |
| 2,912,939 | A | 11/1959 | Miner, Jr. et al. |
| 2,980,037 | A | 4/1961 | Elsner |
| 2,993,708 | A | 7/1961 | Holman, Jr. |
| 3,177,007 | A | 4/1965 | Oren |
| 3,344,750 | A | 10/1967 | Kostrewa |
| 3,559,591 | A | 2/1971 | Breen et al. |
| 3,590,746 | A | 7/1971 | Gibson |
| 3,712,663 | A | 1/1973 | Laven |
| 3,836,174 | A | 9/1974 | Holman, Jr. |

(Continued)

FOREIGN PATENT DOCUMENTS

| | | |
|---|---|---|
| GB | 1209255 | 10/1970 |

*Primary Examiner*—Stephen Gordon
(74) *Attorney, Agent, or Firm*—Barnes & Thornburg LLP

(57) ABSTRACT

A device securable to a corrugated surface of a shipping container by an elongated support for supporting cargo within the shipping container. The device comprising a receptacle defining a cavity for receiving an end of the elongated support, the receptacle having a bottom surface forming a plane for engaging the corrugated surface of the shipping container; and a pair of lateral flaps associated with and disposed about the receptacle for engaging the corrugated surface, each lateral flap having a bottom surface, the bottom surface of each lateral flap extending at an acute angle relative to the plane for engaging the corrugated surface of the shipping container. The device may further define a slot for receiving an end of an other elongated support. A method of making with the device a deck for supporting cargo in a shipping container having a pair of opposed corrugated surface and a base.

24 Claims, 5 Drawing Sheets

U.S. PATENT DOCUMENTS

| | | | | |
|---|---|---|---|---|
| 3,995,565 | A | | 12/1976 | Kersey |
| 4,026,508 | A | | 5/1977 | Ziegler |
| 4,080,906 | A | | 3/1978 | Brown |
| 4,264,251 | A | | 4/1981 | Blatt |
| 4,278,376 | A | | 7/1981 | Hunter |
| 4,396,325 | A | | 8/1983 | Joice-Cavanagh |
| 4,432,678 | A | | 2/1984 | Liebel |
| 4,498,824 | A | | 2/1985 | Kinkle |
| 4,616,757 | A | | 10/1986 | Hobson |
| 4,700,918 | A | | 10/1987 | Andrasko, Jr. |
| 4,735,468 | A | | 4/1988 | Taylor, Jr. et al. |
| 4,756,498 | A | | 7/1988 | Frye |
| 4,830,558 | A | | 5/1989 | Sweeney |
| 4,846,610 | A | | 7/1989 | Schoenleben |
| 4,880,342 | A | | 11/1989 | Pradovic |
| 4,932,817 | A | | 6/1990 | Mattare |
| 4,955,771 | A | | 9/1990 | Bott |
| 4,962,907 | A | | 10/1990 | Gary |
| 4,982,922 | A | | 1/1991 | Krause |
| 5,028,184 | A | | 7/1991 | Krause |
| 5,156,110 | A | | 10/1992 | Fuller |
| 5,219,251 | A | | 6/1993 | Kanczuzewski |
| 5,259,712 | A | | 11/1993 | Wayne |
| 5,281,063 | A | | 1/1994 | Austin, III |
| 5,320,464 | A | | 6/1994 | Long et al. |
| 5,326,204 | A | | 7/1994 | Carlson et al. |
| 5,362,184 | A | | 11/1994 | Hull et al. |
| 5,370,482 | A | | 12/1994 | Long |
| 5,452,972 | A | * | 9/1995 | Adams ..... 410/89 |
| 5,494,389 | A | | 2/1996 | Kanczuzewski |
| 5,688,087 | A | | 11/1997 | Stapleton et al. |
| 5,807,047 | A | | 9/1998 | Cox |
| 6,086,299 | A | | 7/2000 | Kanczuzewski |
| 6,533,513 | B2 | | 3/2003 | Kanczuzewski et al. |

* cited by examiner

DEVICE AND METHOD FOR SUPPORTING CARGO

The present disclosure relates generally to a device and method for supporting cargo in a shipping container.

BACKGROUND

When cargo is being shipped internationally, it typically is shipped in international shipping containers having walls that are corrugated to add strength and rigidity to the shipping containers. Because of the corrugated walls of such shipping containers or any other shipping containers having corrugated walls, it is difficult to secure cargo support devices to the walls.

SUMMARY

The present disclosure is directed to a device securable to a corrugated surface of an international shipping container or other shipping container by a first elongated support for supporting cargo within the shipping container. The device comprises a receptacle defining a cavity for receiving an end of the first elongated support. The receptacle has a bottom surface forming a plane for engaging the corrugated surface of the shipping container. The device also comprises a pair of lateral flaps associated with and disposed about the receptacle for engaging the corrugated surface, each lateral flap having a bottom surface. The bottom surface of each lateral flap extends at an acute angle relative to the plane for engaging the corrugated surface of the shipping container. Depending on the configuration of the corrugations, the acute angle has a magnitude of about 30 degrees.

The device may further define a slot for receiving an end of a second elongated support for interconnecting the device with a floor or other base of the shipping container for further supporting the device. The slot may be defined by the receptacle, such as, for example, by a pair of rails of the receptacle. The device may also include a ramp leading into the cavity for receiving the end of the first elongated support into the cavity. The ramp may define a slot for receiving cargo strapping. The device may also include an adhesive affixed to the bottom surface of the receptacle and the bottom surfaces of the lateral flaps.

The device may be used to support cargo in a horizontal or vertical direction. It may be used to restrain or otherwise support the cargo in a horizontal direction by, for example, securing a pair of the devices to opposed corrugated surfaces with the first elongated support such that the first elongated support is adjacent cargo. When the first elongated support is positioned in place between the two devices, the first elongated support is in compression and thus exerts a tensile or axial force on the devices and the walls, causing the walls to exhibit resilient properties.

The device may also be used to make a deck for supporting cargo. Accordingly, the present disclosure is also directed to a method of making a deck for supporting cargo in a shipping container having a corrugated surface and a base. The method comprises securing a brace or other such device to the corrugated surface with the first elongated support. The brace includes a receptacle defining a cavity, and having a bottom surface forming a plane. The brace includes a pair of lateral flaps disposed about the receptacle, each lateral flap having a bottom surface extending at an acute angle relative to the plane of the bottom surface of the receptacle. The brace is secured to the corrugated surface such that: (i) an end of the first elongated support is received by the cavity and the first elongated support extends substantially parallel to the base; and (ii) the bottom surface of the receptacle engages a trough of the corrugated surface and the bottom surfaces of the lateral flaps engage a pair of ribs of the corrugated surface disposed about the trough. The method also comprises engaging the second elongated support with the brace and with the base, and positioning a decking on the first elongated support for supporting the cargo.

The method may further comprise securing to an opposed corrugated surface of the shipping container an other brace with the first elongated support such that an other end of the first elongated support is received by the cavity defined by the other brace, and engaging an other second elongated support with the other brace and the base. The method may also include securing to the corrugated surfaces with an other first elongated support an other pair of braces, engaging other second elongated supports with the other pair of braces and the base, and positioning the decking on the other first elongated support.

Features and advantages of the disclosure will be set forth in part in the description which follows and the accompanying drawings described below, wherein an embodiment of the disclosure is described and shown, and in part will become apparent upon examination of the following detailed description taken in conjunction with the accompanying drawings.

DETAILED DESCRIPTION

Figure 1:
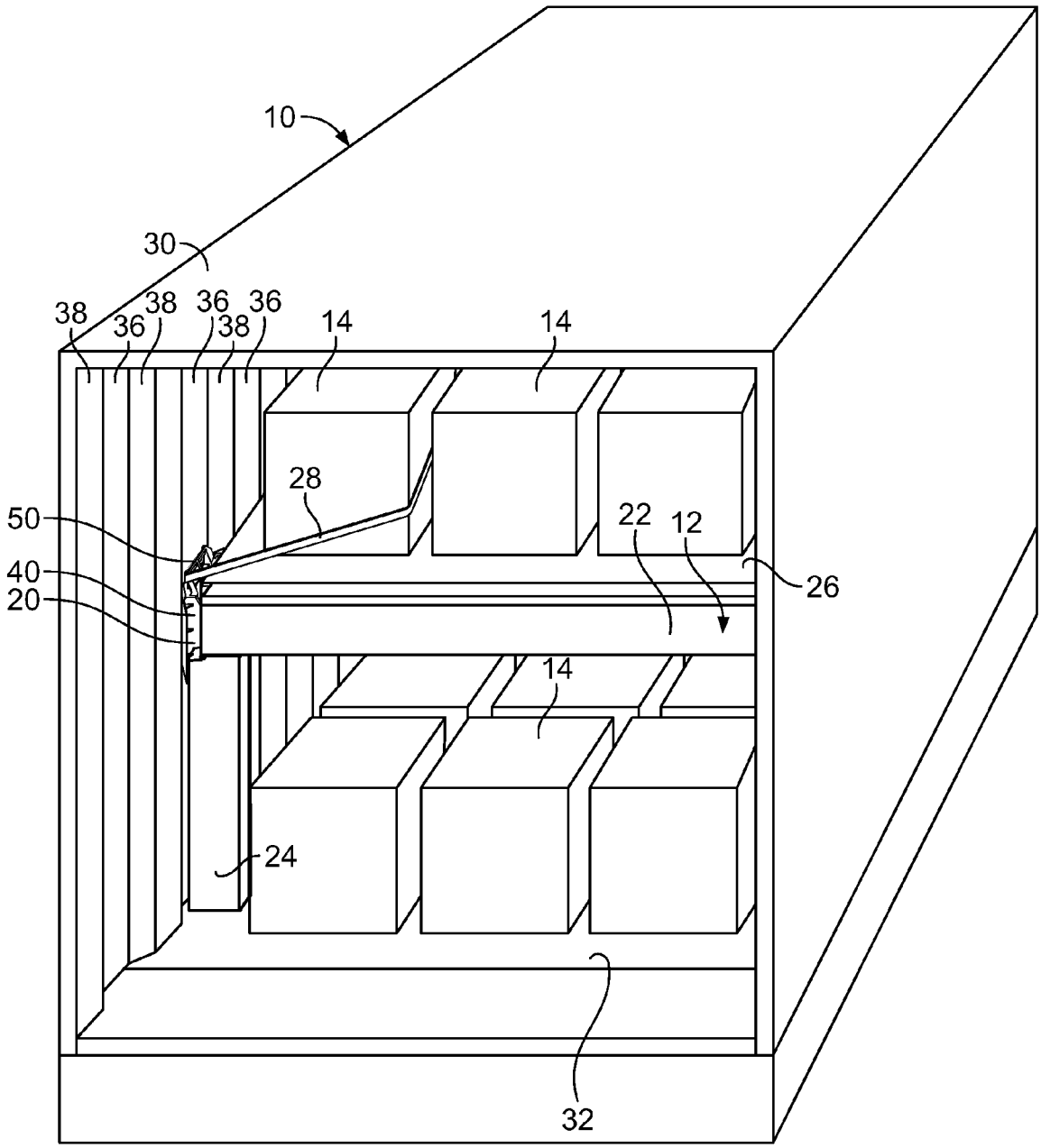
FIG. 1 is a perspective view of a shipping container having corrugated walls and a cargo deck in accordance with an embodiment of the present disclosure.
Figure 2:
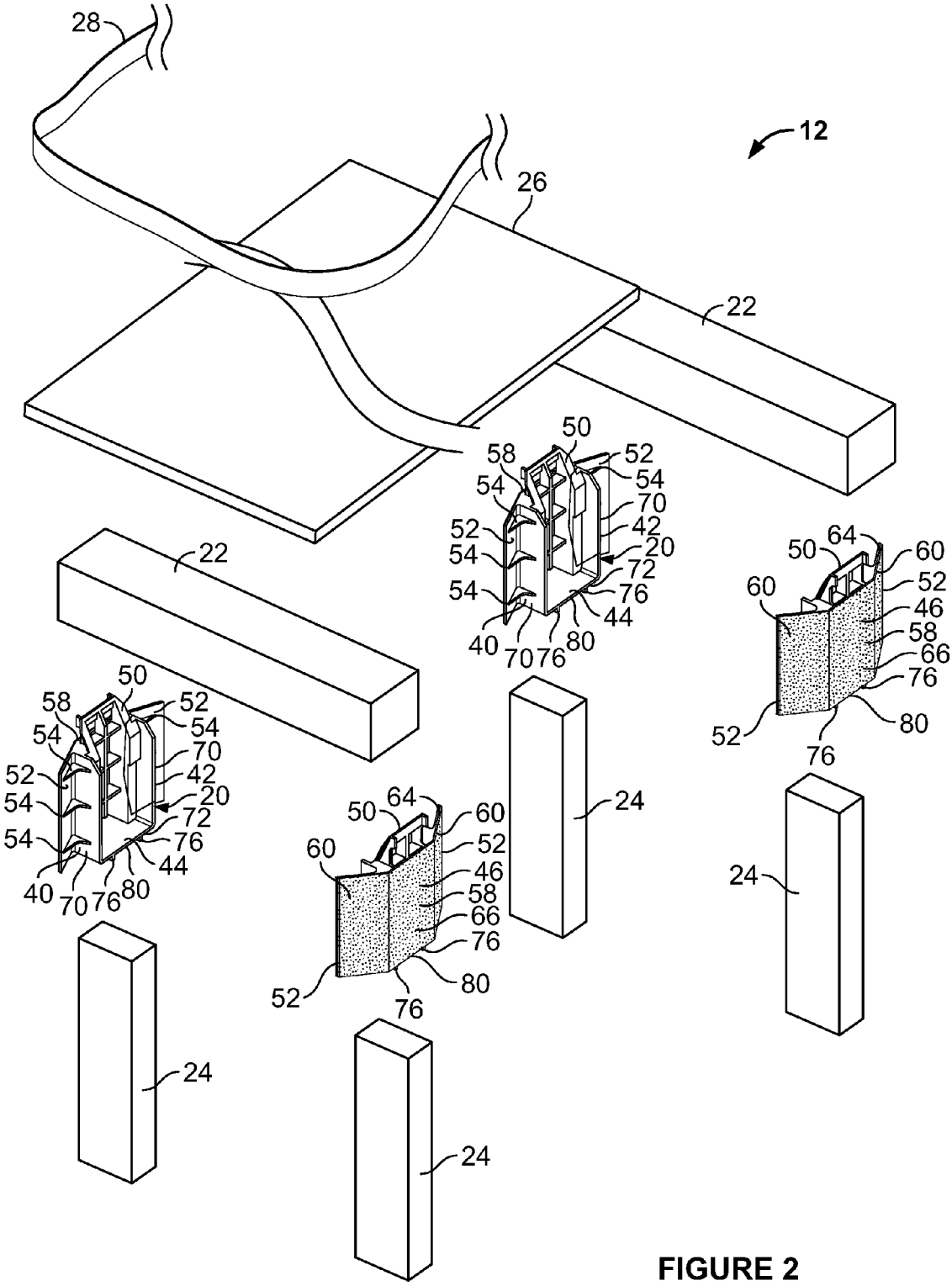
FIG. 2 is a partial, enlarged and exploded view of the cargo deck of FIG. 1.
Figure 3:
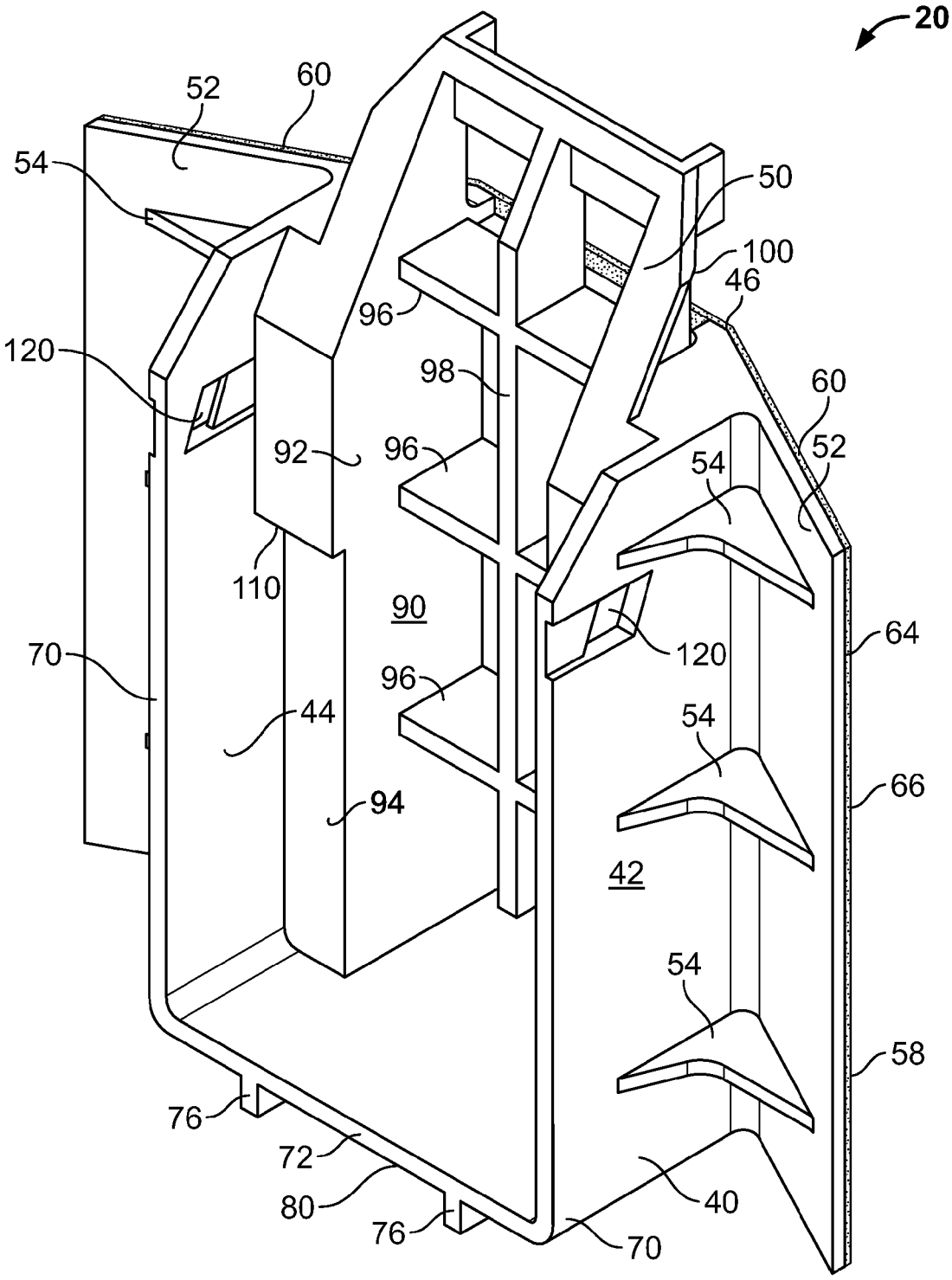
FIG. 3 is a perspective view of one of the braces of the cargo deck of FIG. 1.
Figure 4:
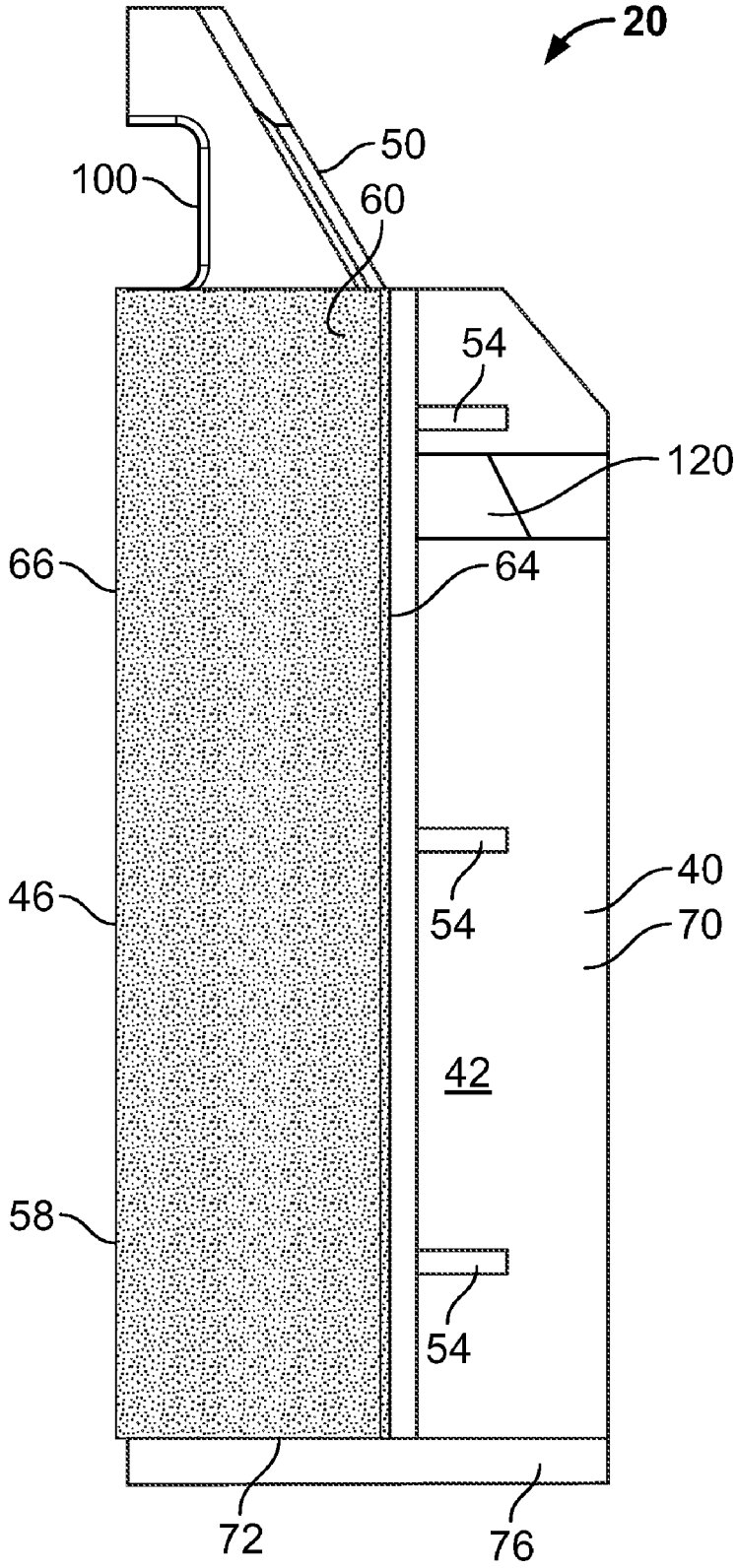
FIG. 4 is a side plan view of one of the braces of the cargo deck of FIG. 1.
Figure 5:
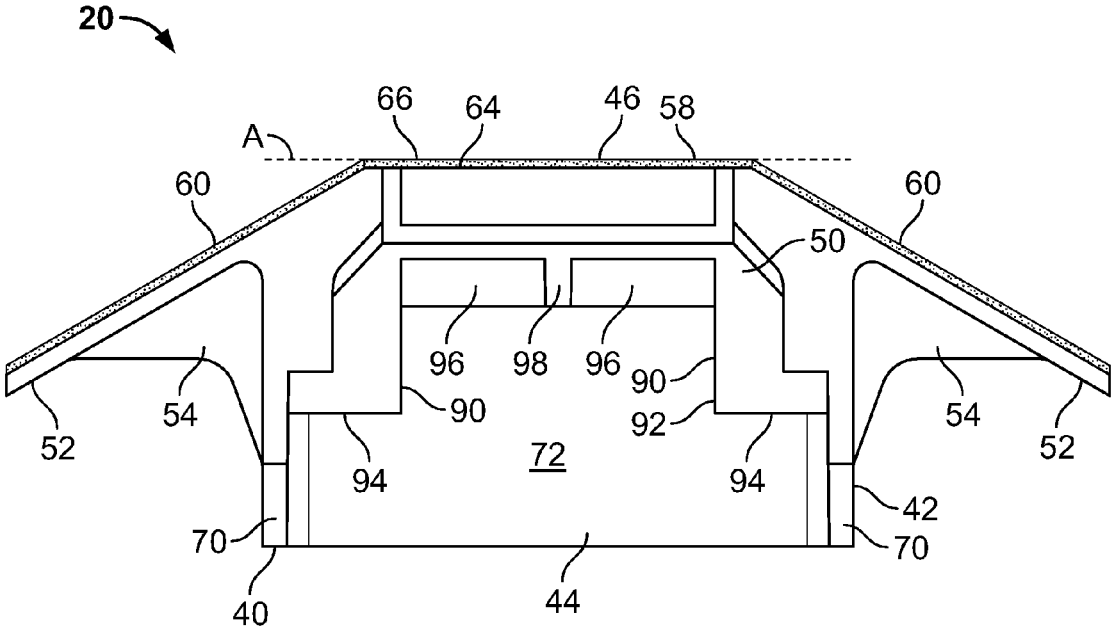
FIG. 5 is a front plan view of one of the braces of the cargo deck of FIG. 1.

FIG. 1 illustrates a shipping container 10 containing a cargo deck 12 in accordance with an illustrated embodiment of the present disclosure having cargo 14 disposed thereon. The cargo deck 12 comprises a plurality of braces 20, a plurality of first elongated supports 22 extending horizontally, a plurality of second elongated supports 24 extending vertically, and a decking 26 supporting cargo 14 in the shipping container 10. The cargo deck 12 also includes cargo strapping 28 for securing some or all of the cargo 14 on the cargo deck. The illustrated shipping container 10 includes a pair of opposed corrugated walls 30 and a floor 32. The braces 20 are secured to the opposed corrugated walls 30 by the first elongated supports 22, and the braces 20 and the decking 26, and are further vertically supported by the second elongated supports 24.

The shipping container 10 can be in the form of a commercially available international shipping container or any other type of shipping container having one or more corrugated walls or other corrugated surfaces. The illustrated corrugated walls 30 comprise a plurality of corrugations comprising troughs 36 and a plurality of ribs 38. Each pair of adjacent ribs 38 is disposed about a respective trough 36. The corrugated walls 30 can have any other suitable configuration in accordance with other embodiments of the present disclosure.

In the embodiment of FIG. 1, the decking 26 is supported by the braces 20, the two first elongated supports 22 and the four second elongated supports 24. The braces 20 of each pair of interconnected braces are secured on the opposed corrugated walls 30 of the shipping container 10 and are interconnected by one of the first elongated supports 22 extending above and parallel to the floor 32 of the shipping container. Each of the elongated supports 22 is in compression and thus exerts a tensile force on the respective pair of braces 22 and the opposed corrugated walls 30. Additionally, each brace 20 is further supported vertically by one of the elongated supports 24 which extends from the brace to the floor 32 of the shipping container 10 to thereby interconnect the brace and the floor. Thus, each pair of braces 20 engages one elongated member 22, which extends horizontally; and each brace 20 engages one elongated member 24, which extends vertically.

The braces 20 in accordance with the present disclosure may be constructed and configured in any suitable manner that facilitates mating engagement with the corrugated wall 30 or other corrugated surface. In the illustrated embodiment, for example, each brace 20 includes a receptacle 40 including a receptacle wall 42 that defines an open-ended cavity 44 for receivably engaging one end of one of the first elongated supports 22. The receptacle 40 includes a substantially flat receptacle bottom surface 46. The brace 20 also includes a ramp 50 leading into the open end of the cavity 44, a pair of lateral flaps 52 disposed about the receptacle 40, a plurality of gussets 54 interconnecting the lateral flaps 52 and the receptacle wall 42, and an adhesive 58. Each of the lateral flaps 52 includes a substantially flat bottom surface 60. The cavity 44 is sized to receive an end of a first elongated support 22 in the form of a 4"×4" wooden support, but the cavity may have any other size and configuration and may be sized to receive any other type of elongated support in accordance with other embodiments of the present disclosure. The adhesive 58 may be affixed separately to each of the bottom surfaces 46 and 60, or may be applied in a single application. The adhesive 58 may be in the form of one or more strips of two-sided tape 64 with removable release layers 66, or may be in any other suitable form in accordance with other embodiments of the present disclosure.

The bottom surface 46 of the receptacle 40 and the bottom surfaces 60 of the lateral flaps 52 are matingly engageable with the corrugations of the corrugated walls 30. In the illustrated embodiment, for example the bottom surfaces 60 of the lateral flaps 52 extend at an acute angle relative to a plane A formed by the bottom surface 46 of the receptacle 40. When the brace 40 is engaged with one of the corrugated walls 30, the bottom surface 46 of the receptacle 40 is engaged with the trough 36 of one of the corrugations and the bottom flat surfaces 60 of the lateral flaps 52 are engaged with the pair of ribs 38 disposed about the trough. This mating engagement, and the tensile force of the first elongated support 22, lock the braces 20 in place on the corrugated walls 30.

The acute angle at which the bottom surfaces 60 of the lateral flaps 52 extend may have a magnitude of about 30 degrees to complement the configurations of the corrugations of most international shipping containers. The acute angle may have any other suitable magnitude to complement any other corrugations. Further, the bottom flat surfaces 46 and 60 may have any other suitable configuration to matingly engage corrugations having configurations different than the corrugation configurations illustrated in FIG. 1.

The receptacle wall 42 includes a pair of lateral walls 70 and a base wall 72 interconnecting the lateral walls defining the open-ended cavity 44. The receptacle wall 42 also includes a pair of rails 76 on the base wall opposite the cavity 44. The rails 76 extend parallel to each other substantially the entire height of the receptacle wall 42 and define a slot 80 for receiving an end of the second elongated support 24. The rails 76 are spaced a sufficient distance to engage the end of a second elongated support 24 in the form of a 2"×4" wooden support. The rails 76 may have any other spacing or any other suitable construction and configuration suitable to engage a 2"×4" wooden support or any other type of elongated support in accordance with other embodiments of the present disclosure and may depend upon the configuration of the elongated support. Further, the slot 80 may instead have any other size and configuration, and may be comprised of structure other than the rails 76, or may be disposed at any other location on the brace 20 in accordance with other embodiments of the present disclosure.

The brace 20 may be constructed of plastic and have a monolithic construction, and may be formed by injection molding. The brace 20 may be constructed of any suitable plastic resin or other plastic. The brace 20 may be constructed by any other suitable means and may have any other suitable monolithic or other construction in accordance with other embodiments of the present disclosure. The decking 26 may be plywood or may be constructed of any other suitable material depending upon the cargo being transported.

The receptacle 40 of the brace 20 also includes a pair of opposed walls 90 disposed between the pair of lateral walls 70 of the receptacle defining a channel 92 therebetween. The pair of opposed walls 90 extend from their base to a lesser height than the lateral walls 70 of the receptacle 40. The receptacle 40 also includes a pair of engaging surfaces 94 which join the lateral walls 70 with the tops of the opposed walls 90 for engaging the respective end of the first elongated support 22 when it is in the receptacle 40 and which define a base of the cavity 44. The walls 90 and the engaging surfaces 94 also form the ramp 50 that extends adjacent the cavity 44 to facilitate a camming or wedging receipt of the end of the first elongated support 22 into the cavity and engagement between the receptacle 40 and the first elongated support 22. In addition, the receptacle 40 includes a pair of lateral ribs 96 interconnecting the pair of opposed walls 90 and a central rib 98 to add strength and rigidity to the brace 20.

The opposed walls 90 of the ramp 50 define a pair of slots 100 for receiving the cargo strapping 28 for restraining cargo movement to provide further cargo transportation benefits. The cargo strapping 28 can be any suitable form of strapping that can be received by the slots 100 to restrain some or all of the cargo 14 disposed on the cargo deck 12 or disposed anywhere else in the shipping container 10.

The engaging surfaces 94 include lips 110 for maintaining the first elongated support 22 in the cavity 44. The height of the opposed walls 90 relative to the lateral flaps 52 is illustrated as being constant from the base wall 72 toward the ramp 50, and then decreases along part of the length of the ramp. The ramp 50 extends outward beyond the opposed walls 90.

The gussets 54 are spaced along the lateral walls 70 of the receptacle 40 and the lateral flaps 52, walls providing additional structural support to the brace 20. Each gusset 54 is joined to the lateral wall 70, and the lateral flap 52. Any other suitable numbers of gussets 54 can be used in accordance with the present disclosure. Further, the gussets 54 may have any other suitable structure or may even be eliminated in accordance with other embodiments of the present disclosure.

Each brace 20 further includes tamper evident means comprising a pair of holes 120 defined on the lateral walls 70 of the receptacle 40 and a tie or cable (not shown) for interconnecting the holes 120 after the first elongated support 22 has been positioned in the receptacle 40. The tie or cable may include a clamp, or zip tie or include any other structure that cannot be removed without being cut or destroyed. The tie or cable may be secured, for example, after the elongated support 22 has been positioned in receptacle 40 to provide tamper evident benefits. Upon arrival of the cargo, the tie or cable can be inspected and, if it has been cut or removed prior to arrival, there is evidence that, depending upon the application, the cargo or the cargo deck 10 has been tampered with during shipment.

The cargo deck 12 in accordance with the present disclosure may be constructed or otherwise made in any suitable manner. For example, one pair of braces 20 may be positioned on the opposed corrugated walls 30 with the ramps 50 facing upward, and secured to the opposed walls by the adhesive 58. One first elongated support 22 may be engaged with the pair of braces 20 by inserting opposed ends of the first elongated support 22 into the cavities 44 of the receptacles 40 of the braces such that the elongated support extends above and across the floor 32 of the shipping container 10. The other pair of braces 20 may then be secured to the opposed corrugated walls 30 in a similar manner at a distance from the first pair of braces.

When engaging the first elongated support 22 with the braces 20, the first elongated support 22 may be positioned relative to the braces and raised slightly vertically above the receptacles 40. The first elongated support 22 is then placed adjacent one or both of the ramps 50 of the braces 20. The first elongated support 22 is then lowered until it contacts one or both ramps 50. After the first elongated support 22 contacts one or both of the ramps 50, pressure is applied to cause the first elongated support to cam or wedge into one or both of the cavities 44 of the pair of braces 20. Once the first elongated support 22 is wedged into place, the first elongated support is in compression and thus exerts a tensile or axial force on the braces 20 and thus the corrugated walls 30 of the shipping container 10, causing the wall 30 to exhibit resilient properties. The ramps 50 provide effective means to maximize the compressive force exerted on the first elongated support 22. The result is that the braces 20 are locked firmly in place.

Before or after the first elongated supports 22 are positioned in place, one of the second elongated supports 24 is disposed between each brace 20 and the floor 32 to provide further vertical support for the cargo 14. The decking 26 is then disposed on the pair of first elongated supports 22. Any suitable cargo 14 can then be disposed on the decking 26 or beneath the decking. Additionally, cargo strapping 28 can be used to restrain cargo 14 in any suitable manner such as, for example, by engaging the cargo strapping with the slots 100 of one or more of the braces 20, wrapping the cargo strapping around some or all of the cargo, and engaging the cargo strapping with the slots of one of the other braces. The tamper proofing means can also be used to provide tamper evident benefits.

The steps for making the cargo deck 12 set forth above can be accomplished in any suitable order. Further, depending upon other structure within or otherwise associated with the shipping container, the cargo deck 12 can be made by using more or less than four braces 20 in accordance with other embodiments of the present disclosure. Still further, although the braces 20 of the illustrated cargo deck 12 are secured to the opposed corrugated walls 30 of the shipping container, depending upon other structure within or otherwise associated with the shipping container, the braces can instead be secured to any other opposed corrugated surfaces associated with a shipping container, such as other cargo or any other secure structure in accordance with other embodiments of the present disclosure. Similarly, the braces 20 of the illustrated cargo deck 12 are interconnected with the floor 32 of the shipping container, but can instead be interconnected with any other base associated with the shipping container, such as other cargo or any other base in accordance with other embodiments of the present disclosure.

The cargo deck 12 in accordance with the present disclosure provides many advantages. For example, cargo 14 can be stacked on or underneath the cargo deck 12, and thus, the cargo deck can be used for stacking over cargo that may not be readily stacked in a shipping container because of the nature or configuration of the cargo, such as, for example, cargo that is likely to be damaged, broken and/or crushed if stacked such as, for example, valuables, dishes, glassware and other glass items, plants, bushes, trees, food items, etc.

Further, the cargo deck 12 in accordance with the illustrated embodiment can be readily constructed in the shipping container without the need for any tools. Also, the braces 20 tend to be inexpensive to manufacture and thus disposable and the first and second elongated supports 22 and 24 also tend to be inexpensive and readily reusable. Thus, such components do not need to be recovered after use or tracked during shipment. Therefore, the cargo deck in accordance with the illustrated embodiment provides a efficient and inexpensive manner for storing cargo in a shipping container.

The lateral flaps 52 of each brace 20 reduce, if not eliminate, the possibility that the brace will roll over as a result of the a shearing stress applied by the first elongated support 22 in either direction. The lateral flaps 52 similarly reduce, if not eliminate, the possibility that the brace 20 will roll back in response to a shearing stress applied by the first elongated support 22 in a back direction. Further, the lateral flaps 52 provide additional surface area for the adhesive 58 and thus additional surface area for engaging the corrugated walls 30 of the shipping container. The gussets 54 add strength and rigidity to the receptacle and also transfer to the lateral flaps 52 any shearing force caused by the first elongated support 22. The ribs 96 included in the receptacle 40 also add strength thereto in a cost effective manner.

The brace 20 in accordance with the present disclosure may be secured on a corrugated wall or other corrugated surface and used in connection with the transportation of cargo in any other suitable manner and to support the cargo in other directions. For example, one pair of braces 20 and one elongated support 22 may be used to restrain cargo by securing the pair of braces to opposed corrugated walls 30 adjacent cargo 14. With such an application, the first elongated support 22 restrains the adjacent cargo by supporting the cargo in a horizontal direction. With such an application, the tamper evident means may be used to determine whether the cargo was tampered with during shipment.

While embodiments have been illustrated and described in the drawings and foregoing description, such illustrations and descriptions are considered to be exemplary and not restrictive in character, it being understood that only illustrative embodiments have been shown and described and that all changes and modifications that come in the spirit of the disclosure are desired to be protected. The description and figures are intended as illustrations of embodiments of the disclosure, and are not intended to be construed as having or implying limitation of the disclosure to those embodiments.

There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall in the spirit and scope of the present disclosure and the appended claims.

The invention claimed is:

1. A device securable to a corrugated surface of a shipping container by an elongated support for supporting cargo within the shipping container, the device comprising:

(a) a receptacle defining a cavity for receiving an end of the elongated support, the receptacle having a bottom surface forming a plane for engaging the corrugated surface of the shipping container; and (b) a pair of lateral flaps associated with and disposed about the receptacle for engaging the corrugated surface, each lateral flap having a bottom surface, the bottom surface of each lateral flap extending at an acute angle relative to the plane for engaging the corrugated surface of the shipping container.

2. The device of claim 1 wherein each acute angle has a magnitude of about 30 degrees.

3. The device of claim 1 further defining a slot for receiving an end of an other elongated support for interconnecting the device with a base of the shipping container for supporting the device.

4. The device of claim 1 wherein the receptacle includes a pair of rails defining a slot for receiving an end of an other elongated support for interconnecting the device with a base of the shipping container for supporting the device.

5. The device of claim 4 wherein the pair of rails extend substantially an entire height of the receptacle.

6. The device of claim 1 further comprising a ramp leading into the cavity for receiving the end of the elongated support into the cavity.

7. The device of claim 6 wherein the ramp defines a slot for receiving cargo strapping.

8. The device of claim 1 further comprising an adhesive secured to the bottom surface of the receptacle and the bottom surfaces of the lateral flaps.

9. A device securable to a corrugated surface of a shipping container by first and second elongated supports for supporting cargo within the shipping container, the device comprising:

(a) a receptacle including a receptacle wall defining a cavity for receiving an end of the first elongated support and defining a slot for engaging an end of the second elongated support, the receptacle further including a bottom surface forming a plane for engaging the corrugated surface of the shipping container; and (b) a pair of lateral flaps associated with and disposed about the receptacle for engaging the corrugated surface of the shipping container, each flap having a bottom surface, the bottom surface of each flap extending at an acute angle relative to the plane of the bottom surface of the receptacle for engaging the corrugated surface of the shipping container.

10. The device of claim 9 wherein each acute angle has a magnitude of about 30 degrees.

11. The device of claim 9 wherein the receptacle wall includes a pair of rails opposite the cavity defining the slot.

12. A method of making a deck for supporting cargo in a shipping container having a corrugated surface and a base, the method comprising:

(a) securing to the corrugated surface with a first elongated support a brace including a receptacle defining a cavity and having a bottom surface forming a plane, the brace also including a pair of lateral flaps disposed about the receptacle, each lateral flap having a bottom surface extending at an acute angle relative to the plane of the bottom surface of the receptacle, such that:

(i) an end of the first elongated support is received by the cavity and the first elongated support extends substantially parallel to the base; and (ii) the bottom surface of the receptacle engages a trough of the corrugated surface and the bottom surfaces of the lateral flaps engage a pair of ribs of the corrugated surface disposed about the trough;

(b) engaging a second elongated support with the brace and with the base; and (c) positioning a decking on the first elongated support for supporting the cargo.

13. The method of claim 12 further including:

(a) securing to an opposed corrugated surface of the shipping container with the first elongated support an other brace including a receptacle defining a cavity and having a bottom surface forming a plane, the other brace also including a pair of lateral flaps disposed about the other brace receptacle, each lateral flap of the other brace having a flat bottom surface extending at an acute angle relative to the plane of the bottom surface of the other brace receptacle, such that:

(i) an other end of the first elongated support is received by the cavity defined by the other brace; and (ii) the bottom surface of the receptacle of the other brace engages a trough of the opposed corrugated surface and the lateral flaps of the other brace engage a pair of ribs of the opposed corrugated surface disposed about the trough of the other corrugated surface; and (b) engaging an other second elongated support with the other brace and the base.

14. The method of claim 13 further comprising;

(a) securing to the corrugated surface and the opposed corrugated surface with an other first elongated support an other pair of braces, each brace of said other pair of braces including a receptacle defining a cavity and having a bottom surface forming a plane, each brace of the other pair of braces also including a pair of lateral flaps disposed about the brace of the other pair of braces-and-respective receptacle of the other pair of braces, each lateral flap of the other pair of braces having a bottom surface extending at an acute angle relative to the plane of the respective receptacle of the other pair of braces, such that:

(i) ends of the other first elongated support are received by the cavities of the other pair of braces and the other first elongated support extends substantially parallel to the base; and (ii) the bottom surface of the receptacle of each brace of the other pair of braces engages an other respective trough of one of the corrugated surfaces and the lateral flaps of each brace of the other pair of braces engage other respective ribs of one of the corrugated surfaces and is disposed about the respective trough; and (b) engaging a pair of other second elongated supports with the other pair of braces and the base; and (c) positioning the decking on the other first elongated support.

15. The method of claim 12 wherein (b) includes disposing an end of the second elongated support in a slot defined by the brace.

16. The method of claim 12 wherein (b) includes disposing an end of the second elongated support in a slot defined by a pair of rails of the brace.

17. The method of claim 12 wherein (b) includes disposing an end of the second elongated support in a slot defined by a pair of parallel rails of the brace.

18. The method of claim 12 wherein (b) includes engaging an end of the second elongated support with a pair of rails of the brace, the rails extending parallel to each other along substantially entire height of the brace and defining a slot receiving the end of the second elongated support.

19. The method of claim 12 wherein the securing of (a) includes disposing the end of the first elongated support in a cavity defined by a receptacle of the brace.

20. The method of claim 19 wherein (b) includes disposing an end of the second elongated support in a slot defined by the receptacle of the brace.

21. The method of claim 19 wherein (b) includes disposing an end of the second elongated support in a slot defined by a pair of rails of the receptacle of the brace.

22. The method of claim 13 wherein the first recited step (a) includes securing the brace to the corrugated surface with an adhesive.

23. A method of making a deck for supporting cargo in a shipping container having opposed corrugated surfaces and a base comprising:

(a) securing to the opposed corrugated surfaces with a first elongated support a pair of braces, each brace including a receptacle defining a cavity and having a bottom surface defining a plane, each brace also including a pair of lateral flaps disposed about the receptacle, each lateral flap having a bottom surface extending at an acute angle relative to the plane of the bottom surface of the receptacle, such that:

(i) each of ends of the first elongated support is received by the cavity of a respective one of said braces and the first elongated support extends substantially parallel to the base; and (ii) the bottom surface of the receptacle of each brace engages a trough of a respective one of the opposed corrugated surfaces and the lateral flaps of each brace engage a pair of ribs of the respective corrugated surface disposed about the trough;

(b) engaging a pair of second elongated supports with the pair of braces, each second elongated support interconnecting a respective one of said braces and the base; and (c) positioning a decking on the first elongated support for supporting the cargo.

24. The method of claim 23 further including:

(a) securing to the opposed corrugated surfaces with an other first elongated support an other pair of braces, each brace of the other pair of braces including a receptacle defining a cavity and having a bottom surface forming a plane, each brace of the other pair also including a pair of lateral flaps disposed about the respective receptacle of the other pair of braces, each lateral flap of the other brace having a bottom surface extending at an acute angle relative to the plane of the bottom surface of the respective other brace receptacle such that:

(i) each of ends of the other first elongated support is received by the cavity of a respective brace of the other pair of braces and the other first elongated support extends substantially parallel to the base; and (ii) the bottom surface of the receptacle of each brace of the other pair of braces engages an other trough of a respective one other opposed corrugated surfaces and the lateral flaps of each brace of each of the other pair of braces engage other ribs of the respective corrugated surface disposed about the other trough;

(b) engaging an other pair of second elongated supports with the other pair of braces, each second elongated support of the other pair of second elongated supports interconnecting a respective brace of the other pair of braces and the base; and (c) positioning the decking on the other first elongated support.

* * * * *